United States Patent [19]

Zimmerman

[11] 3,968,006

[45] July 6, 1976

[54] PULP BLEACHING PROCESS CONTROL USING PHOTOCELLS TO MEASURE PULP BRIGHTNESS

[75] Inventor: William E. Zimmerman, Covington, Va.

[73] Assignee: Westvaco Corporation, New York, N.Y.

[22] Filed: Feb. 3, 1975

[21] Appl. No.: 546,414

[52] U.S. Cl. ..... 162/198; 162/238; 162/49; 162/DIG. 10; 250/576; 338/15; 338/19; 356/181

[51] Int. Cl.[2] ..... D21C 9/10; D21C 9/12

[58] Field of Search ..... 162/49, 238, 263, 198, 162/DIG. 10, 87; 250/576; 356/181, 209; 338/15, 19

[56] References Cited

UNITED STATES PATENTS

| | | | |
|---|---|---|---|
| 1,935,698 | 8/1931 | Decker et al. | 338/19 |
| 3,465,550 | 9/1969 | Strom et al. | 162/238 X |
| 3,773,424 | 11/1973 | Selgin | 250/576 X |

OTHER PUBLICATIONS

Obenshain, "Black Widow Bleaching Control System," pp. 1–9, *TAPPI*, vol. 41, No. 1, Jan. 1958.

Burnett; "Computer Control of the Chlorine Stage," pp. 57–62, *Pulp and Paper Magazine of Canada*, vol. 71, No. 14, July 17, 1970.

Robinson et al.; "A Computer Control System for a Multi-Stage Bleach Plant," *Paper Trade Journal*, May 14, 1973.

U.S. Published Patent Application, B300,004, Putman, "Computer Control System for Paper Pulp Bleach Plant," Jan. 28, 1975.

Shera; "Systems Compatibility for ORP Pulp Chlorination Control," *TAPPI;* vol. 50, No. 2, pp. 99a–103a, Feb. 1967.

*Primary Examiner*—S. Leon Bashore
*Assistant Examiner*—M. Steve Alvo
*Attorney, Agent, or Firm*—W. Allen Marcontell; Richard L. Schmalz

[57] ABSTRACT

To achieve constant brightness from the chlorine stage of a wood pulp bleaching system, the chlorine addition rate is controlled by two white light photosensors positioned, respectively, 1–5 minutes downstream of the chlorine addition point and immediately prior to the chlorine washers. A relative error signal from the late photosensor is cascaded upon the set-point of a signal differentiator for the early photosensor to generate a chlorine valve control signal. The photosensors comprise selenium photocells positioned against a transparent stock conduit window and reflection illuminated by a low power white light source positioned more remotely from the window than the photocell at a discreet offset angle relative thereto. The white light is directed past the photocells, through the windows and into the flow stream; the photocells being responsive to the relative magnitude of white light reflected from the wood pulp. The power generated from the photocell is correlated to the pulp brightness.

6 Claims, 3 Drawing Figures

PULP BLEACHING PROCESS CONTROL USING PHOTOCELLS TO MEASURE PULP BRIGHTNESS

BACKGROUND OF THE INVENTION

1. Field of the Invention

The present invention relates to the bleaching of wood pulp. More specifically, the present invention relates to the flow control of chlorine as a wood pulp bleaching agent for the purpose of achieving a constant magnitude of pulp brightness.

2. Description of the Prior Art

Pursuant to the manufacture of paper and similar cellulosic products from wood, chips of the raw material are usually subjected to a thermochemical process known as digestion wherein the lignin binder of the natural cellulose fibers is, to varying degrees, dissolved, degraded and otherwise loosened from the fiber bond.

Although the dominant percentage of original lignin is removed in the digestion process, the resulting pulp is dark brown in color due to residual color bodies originating from the remaining lignin. If a white product is the objective use of the pulp such dark color bodies must be removed therefrom.

The prior art technique of removing color bodies from wood is characterized as the bleaching process which comprises several sequential steps of combining chemicals with a dilute aqueous slurry of the pulp followed by washing. Conventionally, the first of such sequential steps includes the addition of liquid or gaseous chlorine for the purpose of reacting with the residual lignin. The chlorine stage of the bleaching process is followed by the addition of caustic or sodium hydroxide for the purpose of dissolving and mobilizing the chlorinated lignin. Subsequently, the pulp may be treated with calcium or sodium hypochlorite for the purpose of further solubilizing remaining lignin compounds. Finally, the pulp is combined with chlorine dioxide which reacts primarily with the cellulose fibers to oxidize the surfaces thereof to impart a greater degree of reflectance, hence, whiteness, to the pulp.

The present invention is directed to the first or chlorine addition step of the bleaching process and the method and apparatus for controlling such chlorine additions.

Further to the prior art, washed pulp from the digestion step is mixed with chlorine and thereafter allowed a predetermined time of residence for the purpose of chemical reaction. The duration of such residence, which may be from 15 to 90 minutes, depends on the stock flow rate relative to the volumetric capacity of conduits and tankage between the chlorine addition point and the chlorine washers. Since in most pulp mills, the volumetric capacity is constant and the flow rate is variable for reasons independent of the bleaching process, the process may be controlled only by the chlorine addition flow rate.

Although a constant brightness or whiteness is the common objective of most bleach processes, the usual prior art control parameter of chlorine addition is that of chlorine residual. This term relates to the percentage of unreacted chlorine in the flowing pulp mass at a fixed distance downstream of the addition point. Chlorine residual is measured by electrically sensing the oxidation reduction potential of the aqueous solution which carries the pulp. Such a system is described by T. C. Burnett, Pulp And Paper Magazine Of Canada, Vol. 71, No. 14, July 17, 1970, pg. 57–62.

Chlorine residual may be related to pulp brightness only by operational history of a particular pulp mill and bleaching plant. The magnitude of chlorine residual at a fixed point in a flow stream required for a given degree of brightness at the end thereof would depend on the consistency of the water-pulp slurry, the relative quantity of lignin remaining in the dark pulp (a complex factor characterized as the pulp "K" number), the momentary stock flow rate and the stock temperature. All of these parameters are, in actual operation, highly variable, each being independent of the others. Therefore, a historical correlation between final brightness and chlorine residual may only achieve an average level of effectiveness. When the momentary stock conditions are such as to result in departure from the historical average, the pulp fibers are either weakened by the addition of excessive chlorine or, in the case of too little chlorine addition, additional bleaching burdens are thrust upon the subsequent bleaching steps. In such latter case, the cost/effectiveness of supplementary bleaching by the tertiary steps is poor as compared to that of chlorine treatment.

Although control of chlorine addition by the chlorine residual technique is generally understood by the industry as being the most economical approach, the usual cost equation considers only the chlorine cost relative to a given degree of brightness for typical pulp properties and flow conditions. When the cost equation is expanded to account for the quality loss due to overchlorination or the diminished cost/effectiveness of tertiary step supplementation due to under chlorination, the singular factor of chemical cost significance dims considerably.

Notwithstanding such foregoing complexities, the first object of pulp bleaching is that of constant brightness and the most efficient known technique of achieving the objective, as a first step thereto, is by chlorine addition. Accordingly, sufficient chlorine should be added to the stock to accomplish the desired brightness regardless of chlorine residual at some fixed flow stream point. Pursuant to this objective, therefore, brightness should be the primary process control parameter.

An objective standard for measuring pulp brightness is as a percentage of reflectance from a white light source filtered to 457 millimicrons. In practice, however, such a standard is largely arbitrary since the human eye, perceptive of the entire white light spectrum, is the final judge of the quality.

Numerous instruments have been devised to measure the magnitude of white light reflectance from a surface such as that described by U.S. Pat. No. 3,771,877 to R. Rosencranz. Moreover, white light photosensors to control chlorine addition to a wood pulp bleaching flow stream were suggested by D. Noel Obenshain, TAPPI, Vol. 41, No. 1, January 1958, pg. 1. As in the case of residual chlorine measurement, however, the interacting independent variables of consistency, temperature and residence time strongly affect the reliability of such prior art photosensory chlorine control systems. In the case of the obenshain system, the difficulties were distributed among the facts of consistency, temperature and the long (15 to 90 minutes) residence time between chlorine addition and photo-sampling. This latter factor created an unreasonably long lag time between disturbance and detection in the feedback control loop.

Accordingly, it is the objective of the present invention to provide a photosensory bleach control system having a very short time delay in the feedback control loop but which is simultaneously insensitive to variations in consistency, residence time and temperature.

Another objective is to provide a simple photosensory apparatus for detecting slurried pulp brightness regardless of consistency variations.

BRIEF DESCRIPTION OF THE INVENTION

These and other objectives of the present invention are accomplished in a stock flow stream of at least 15 minutes duration between a chlorine injection point and the washers by viewing the stock flow through transparent windows at two spaced locations, approximately 1 to 5 minutes and prior to the washer (usually 20 to 30 minutes), respectively, downstream of the chlorine addition point. Respective to each view window is a flat plate selenium photocell disposed contiguously coplanar with the outer surface of the window. Illumination is provided by a low power white light source positioned at a discreet reflective angle relative to the photocell sensing face. The remote downstream photocell, located near the end of the chlorine stage flow stream, is responsive to the slow, long term deviations from established quality norms. Accordingly, the signal therefrom is compared to a predetermined manual set-point with the differential error signal being cascaded upon the set-point of the 1 to 5 minute downstream sensor. This short downstream time photosensor, because of the short reactive time proximity to the chlorine injection point, is incapable of distinguishing between short term and long term process shifts. Accordingly, the remote photocell signal is used as a floating reference for the short time signal set-point. The differential error signal from the short time photosensor is translated by a valve controller to regulate the setting of the chlorine addition valve.

BRIEF DESCRIPTION OF THE DRAWING

Relative to the drawing wherein like reference characters designate like or similar elements.

DESCRIPTION OF THE PREFERRED EMBODIMENT

Figure 1:
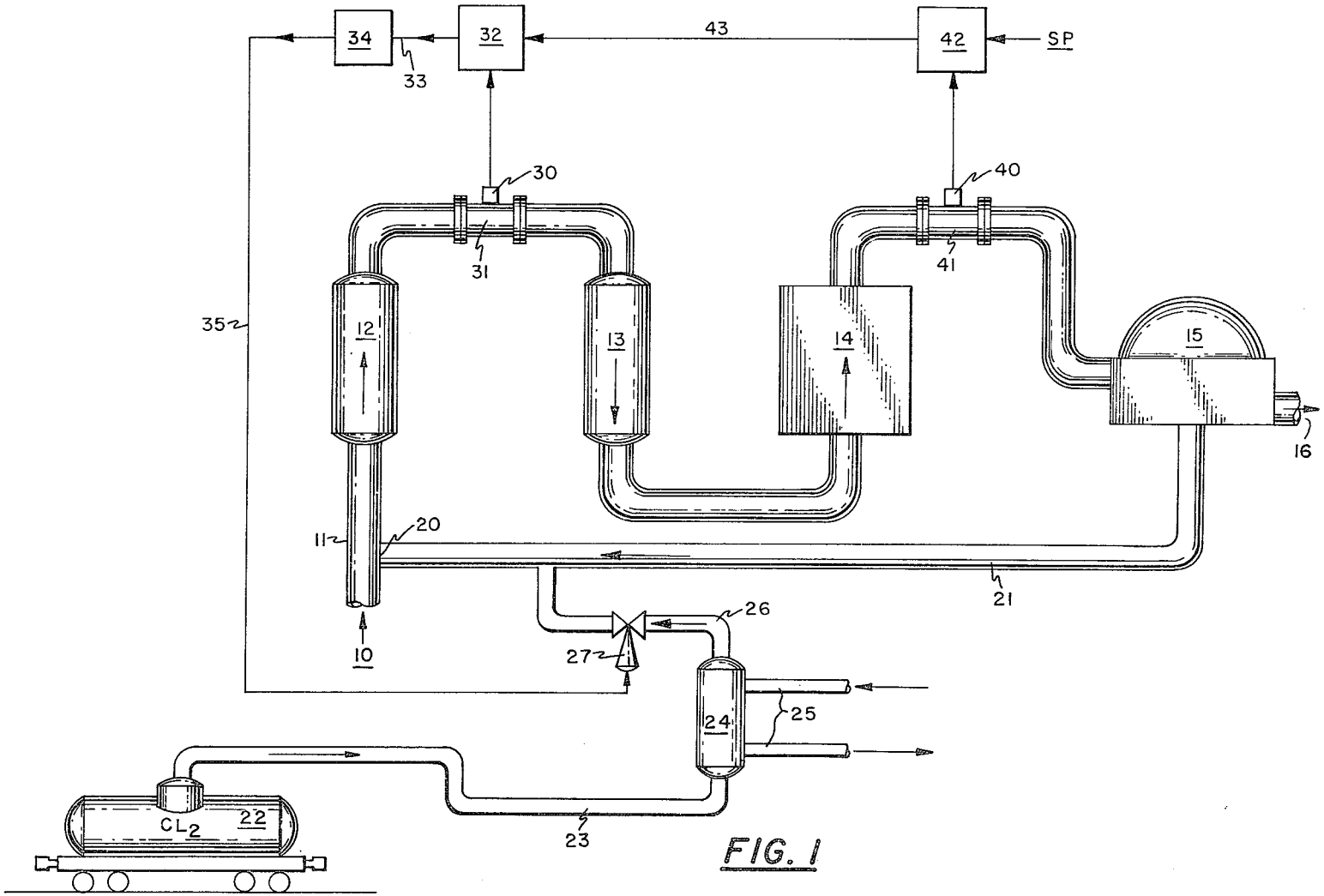
FIG. 1 is a chlorine bleach stage flow schematic also illustrating the photosensor signal management system.

The macro flow scheme of the present invention is illustrated schematically by FIG. 1 wherein dark pulp from the brown stock washers enters the bleach system at position 10 through flow pipe 11. Enlarged crosssectional piping elements 12 and 13 are characterized as preretention tubes and provide additional volumetric capacity in the flow system downstream of the chlorine addition point 20. Conventional bleach plant design provides approximately 1 to 5 minutes of chlorinated slurry retention time in each of such preretention tubes 12 and 13.

Tankage element 14 represents a 15 to 20 minute retention vessel through which the thoroughly mixed slurry is allowed to traverse quiescently to maximize the opportunity for reactive effectiveness of the chlorine.

Following the retention vessel 14, the chlorinated slurry is directed to one or more drum washers 15 whereupon the chlorinated solution vehicle for the slurry is flushed from the fibers.

From the washers 15, the fibers are reslurried with a causticized aqueous solution and transported from the chlorination subsystem at departure point 16.

A portion of the chlorinated solution filtrate flushed from the slurry by washers 15 is drawn therefrom by conduit 21 for recycle solvent.

Liquid chlorine, from mobile tankage 22 for example, is pumped through conduit 23 to indirect heat exchanger 24 to be gasified by the addition of heat as provided by steam lines 25.

Exit flow of gaseous chlorine through conduit 26 is regulated by a motorized flow control valve 27.

Relative to the present invention, photosensors 30 and 40 are positioned in the flow system adjacent respective windowed sections of flow conduits 31 and 41.

Photosensor 30 is conveniently positioned within a downstream portion of the first preretention tube 12 or subsequent thereto as shown. Preferably, the location of photosensor 30 is 1 to 5 minutes downstream of the chlorine addition point 20 as determined by nominal flow.

Photosensor 40 is positioned late in the flow stream between retention vessel 14 and the first washer drum 15. It is preferable to be as near to the washer drum as convenience permits. In an actual case of a rapid chlorination system, photosensor 40 was successfully positioned at twenty minutes downstream of addition point 20.

In the schematic of FIG. 1, photosensor 40 brightness signals are transmitted to a differentiator 42 for comparison to a manually determined setpoint signal SP. This manual set-point SP is an essentially constant function which translates the operator desired level of stock brightness to the quantitative electrical "language" of the photosensor 40. Consequently, set-point SP is the reference standard to which is compared momentary signals generated by the photosensor 40 responsive to the brightness property of the in-transit stock. Such comparisons yield an error signal 43 comprising a positive or negative differential of particular magnitude; or, in the case of an identity between generated signals and the set-point SP, a zero differential.

Error signal 43 is transmitted to a similar differentiator 32 for receipt as the set-point thereof. Differential 32 also receives generated signals from photosensor 30. Normally, a historically derived algorithmic function will correlate the error signal 43 to photosensor 30 generated signal. In any case, however, the error signal 43 will be cascaded upon any independently existant set-point for the differentiator 32.

Resultantly, differentiator 32 will yield an error signal 33 for receipt by a motor control amplifier 34 which translates the signal 33 to an appropriate fluid or electrical power signal 35 for operation of chlorine valve 27.

Figure 2:
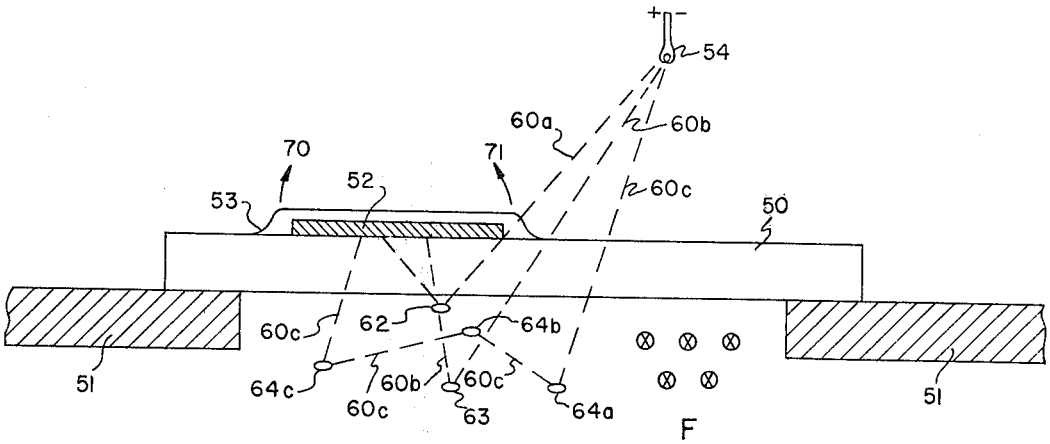
FIG. 2 is a sectional schematic of the subject photosensor.

FIG. 2 illustrates the physical details of photosensors 30 and 40 wherein element 50 is an optically transparent window in the conduit wall 51 which contains stock flow stream F.

Secured to the outer face of the window 50 is a self-generating type of selenium photocell 52 having a spectral sensitivity approximating that of the human eye. The flat plane of the selenium cell unit 52 is preferably bonded directly to the outer window face and atmospherically sealed with a protective coating 53 such as Goodyear Pliobond.

An incandescent or other white light source 54 is offset positioned behind the cell 52 whereby only reflected light will impinge on the photosensitive surface thereof. While a great degree of design freedom is available in the selection of illumination power, photocell size, and physical spacing therebetween, it has been found that a 1-9/16 inch × 1-7/16 × 1/32 inch rectangular prism photocell distributed by the Edmund Scientific Co. of Barrington, N.J., as Stock No. 30,728 secured to a 0.25 inch thickness window of construction grade Plexiglas and illuminated by a 7.5 watt incandescent lamp positioned 1.0 inch cross-stream of the most proximate 1-9/16 inch photocell edge and 1.0 inches above the outer window face is substantially self compensating as to ±20% stock flow variations from a 3,000 gpm norm and ±0.5% consistency variations from a 4.0% norm.

Figure 3:
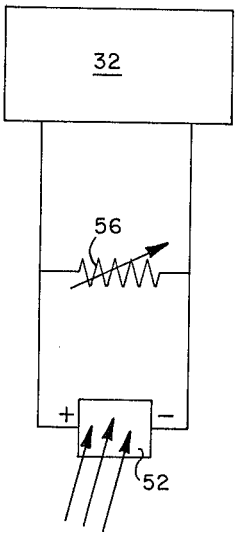
FIG. 3 is an electrical schematic showing the subject photocell power output circuit.

The electrical schematic of the installation described is represented by FIG. 3 wherein the 0 to 100 millivolt, 0 to 10 microwatts power output of the selenium cell 52 is applied directly against the load of differentiator 32. A 0–2000 ohm variable load resistance 56 between the photocell power leads is provided to keep the photocell 52 from saturating and provide a convenient device for calibrating the particular installation.

No attempt has been made to analyze the exact parametric limits of the present photocell arrangement since the total simplicity thereof lends itself to a rapid trial-and-error installation. It is known, however, that the selenium cell 52 sensitive face should be maintainend approximately parallel with the face of window 50 and as close thereto as practical. It is also known that photosensitive solid state devices other than selenium, silicon for example, do not have the same spectral sensitivity. Silicon photocells tend to be excessively sensitive to the red and near infra-red end of the spectrum. Moreover, silica photocells are susceptible to large ambient temperature drifts.

Other experiments have shown that the aforedescribed photosensor will become critically sensitive to stock consistency variations if the light source 54 is positioned too far from the photocell 52; notwithstanding increased light power.

As understood, all light impinging on the photosensitive face of cell 52 must be reflected but after subjection to different light path conditions. A certain portion of the total light reaching the photosensitive face of the photocell follows the direct path of beam 60*a* reflecting directly from the surface of a shallow fiber 62.

Another portion of the total light reaching the photosensitive face follows the path of beam 60*b* which reflects directly from a more deeply immersed fiber 63.

Still a third portion of the total light reaching the photosensitive face follows the path of beam 60*c* which reflects off the surfaces of two or more fibers 64*a*, *b* and *c* before reaching the photosensitive cell face.

When these several light paths are considered from the aspect of a constant brightness pulp in a flow stream of varying consistency, it is found that as the consistency increases, light following the paths of beams 60*a* and 60*b* becomes the predominate photocell excitation source.

Conversely, as flow stream consistency decreases, light following the path of beam 60*c* predominates as the photocell excitation source.

By manipulating the exact angle and proximity of the light source 54 relative to the photocell 52, the two aforedescribed, oppositely responding, consistency change results will become mutually canceling or neutralizing to effect a constant photocell power output as constant pulp brightness throughout the normal range of consistency and flow rate fluctuations.

As a technique of first trial and error installation, it is suggested that the physical arrangement of the several photosensor components closely approximate that described above but with the photocell 52 power output loaded against quantitative measuring instrumentation. Using a pulp of known constant brightness, note the effect of known consistency changes on the photocell power output. If the power output increases with increased consistency to indicate an excess quantity of light beam 60*a* and 60*b* energy exciting the photocell, the angle between the photocell 52 and the light source 54 should be modestly changed by lifting the more remote (from the light source) edge of the photocell slightly away from the outer window plane as indicated by FIG. 2 movement reference 70. On the other hand, if power output decreases with increased consistency an excess quantity of light beam 60*c* energy is indicated, therefore the more proximate edge of the photocell should be lifted slightly away from the outer window plane as indicated by FIG. 2 movement reference 71.

By the foregoing procedure, a positional relationship between the photocell 52 and the light source 54 may be found whereat no change in the photocell power output will occur through the normal range of consistency variation.

Obviously, the foregoing installation calibration procedure may be performed by manipulating the light source 54 position relative to a fixed photocell 52 position. However, this alternative procedure carries the attendant probability of altering the illumination intensity on the sampling area thereby introducing a second unknown variable in the calibration logic.

It will also be understood from the foregoing procedure that descriptions herein relative to the parallelism of the photocell 52 to the outer plane of window 50 are approximations for the purpose of installation guidance.

Having fully described my invention, I claim:

1. A chlorine flow control system for the bleaching of wood pulp, said system comprising:

A. a continuous flow stream of wood pulp suspended as a dilute aqueous slurry;

B. a conduit for carrying said flow stream having sufficient volumetric capacity to retain an element of said flow stream at least fifteen minutes between a chlorine solution injection point in said flow stream and pulp washing means at the end of said flow stream;

C. First transparent window means in said conduit approximately one to five minutes downstream of said chlorine injection point;

D. Second transparent window means in said conduit prior to said pulp washing means;

E. First and second selenium photocells having photo-sensitive face planes secured contiguous with outer planes of respective window means wherein the photocells form an angle relative to said respective window means neutralizing the effect of consistency;

F. A source of white light directed past said photocells, through said windows and into said flow stream, said photocells being responsive to the relative magnitude of white light reflected from said wood pulp to emit respective first and second electrical signals proportional thereto;

G. First differentiator means to receive said second photocell signal from said second photocell for comparison to an independently variable first set-point signal.

H. Second differentiator means to receive said first photocell signal for comparison to a second set-point signal that is dependently variable relative to the difference between said second photocell signal and said first set-point signal; and, I. Chlorine flow regulating means for controlling the flow of chlorine into said flow stream at said injection point responsive to the difference between said first photocell signal and said second set-point signal.

2. A system as described by claim 1 wherein said white light emanates from an incandescent lamp.

3. A chlorine flow control system for the bleaching of wood pulp, said system comprising:

A. A continuous flow stream of wood pulp suspended as a dilute aqueous slurry;

B. A conduit for carrying said flow stream having volumetric capacity to retain an element of said flow stream at least sixteen minutes between a chlorine solution injection point in said flow stream and pulp washing means at the end of said flow stream;

C. First and second transparent window means in said conduit downstream of said chlorine injection point, said window means being separated by at least fifteen minutes of flow stream element transit therebetween;

D. First and second selenium photocells having photo-sensitive face planes secured contiguous with outer planes of said first and second window means, respectively wherein the photocells form an angle relative to said respective window means neutralizing the effect of consistency;

E. A source of white light directed past said photocells, through said windows and into said flow stream, said photocells being responsive to the relative magnitude of white light reflected from said wood pulp to emit respective first and second electrical signals proportional thereto;

F. First differentiator means to receive said second photocell signals for comparison to a first set-point signal;

G. Second differentiator means to receive said first photocell signals for comparison to a second set-point signal that is dependently variable relative to the difference between said second photocell signal and said first set-point signal; and, H. Chlorine flow regulating means for controlling the flow of chlorine into said flow stream at said injection point responsive to the difference between said first photocell signal and said second set-point signal.

4. A system as described by claim 3 wherein said white light emanates from an incandescent lamp.

5. A method for measuring the brightness of a low consistency slurry of wood pulp, said method comprising the steps of:

A. Providing a transparent window in a conduit carrying a low consistency flow stream of wood pulp, said window having an exterior planar surface disposed substantially parallel to the flow direction of said flow stream;

B. Positioning a selenium photocell having a planar, photo-sensitive face contiguously adjacent said exterior window surface;

C. Providing a source of white light directed past said photocell, through said window and into said flow stream;

D. Adjusting the planar angle of said photocell relative to said flow stream flow direction and the position of said light source to neutralize the effect of consistency variations in said flow stream on the power generation response of said photocell;

E. Measuring the magnitude of electrical power generated by said photocell responsive to light reflected from said flow stream, and;

F. Correlating photocell power generation responses to relative magnitudes of wood pulp brightness.

6. A method as described by claim 5 wherein said white light source is provided by an incandescent light.

* * * * *

UNITED STATES PATENT OFFICE

CERTIFICATE OF CORRECTION

PATENT NO. : 3,968,006

DATED : July 6, 1976

INVENTOR(S) : William E. Zimmerman

It is certified that error appears in the above-identified patent and that said Letters Patent are hereby corrected as shown below:

Column 2, line 62, the word "Obenshain" is a proper name and should be started with a capital --O--. Column 5, line 33, correct the spelling of --tained--; line 39, correct the spelling of --silicon--.

Signed and Sealed this

Ninth Day of November 1976

[SEAL]

*Attest:*

RUTH C. MASON
*Attesting Officer*

C. MARSHALL DANN
*Commissioner of Patents and Trademarks*